US010612273B2

(12) United States Patent
Litwinski et al.

(10) Patent No.: US 10,612,273 B2
(45) Date of Patent: Apr. 7, 2020

(54) ANTI-BARRICADING THUMB TURN ASSEMBLY FOR A DOOR LOCKSET

(71) Applicant: Schlage Lock Company LLC, Carmel, IN (US)

(72) Inventors: Adam M. Litwinski, Centennial, CO (US); Douglas A. Holmes, Golden, CO (US)

(73) Assignee: Schlage Lock Company LLC, Carmel, IN (US)

( * ) Notice: Subject to any disclaimer, the term of this patent is extended or adjusted under 35 U.S.C. 154(b) by 101 days.

(21) Appl. No.: 15/919,477

(22) Filed: Mar. 13, 2018

(65) Prior Publication Data

US 2019/0284840 A1 Sep. 19, 2019

(51) Int. Cl.

| | |
|---|---|
| ***E05B 63/00*** | (2006.01) |
| ***E05B 17/00*** | (2006.01) |
| ***E05B 17/04*** | (2006.01) |
| *E05B 15/04* | (2006.01) |

(52) U.S. Cl.

CPC ..... *E05B 63/0069* (2013.01); *E05B 17/0058* (2013.01); *E05B 17/045* (2013.01); *E05B 2015/042* (2013.01)

(58) Field of Classification Search

CPC ..... E05B 63/0069; E05B 17/045; E05B 17/0058; E05B 17/046; E05B 2015/042; E05B 2015/105

USPC ..... 70/188, 189, DIG. 42, DIG. 54, 416, 70/DIG. 3, 222, 223, 422, 379 R, 379 A, 70/380; 292/336.3, 347, DIG. 27, 292/DIG. 61, DIG. 62

See application file for complete search history.

(56) References Cited

U.S. PATENT DOCUMENTS

| | | | | |
|---|---|---|---|---|
| 1,611,940 A * | 12/1926 | Ohmer | ..... | G07B 13/005 464/37 |
| 4,042,268 A * | 8/1977 | Coglan | ..... | E05B 3/065 292/347 |
| 4,676,083 A * | 6/1987 | Sedley | ..... | E05B 13/005 192/93 R |
| 4,922,737 A | 5/1990 | Urby | | |

(Continued)

FOREIGN PATENT DOCUMENTS

| | | |
|---|---|---|
| EP | 1223270 | 8/2006 |
| GB | 2334546 | 8/1999 |

(Continued)

*Primary Examiner* — Lloyd A Gall

(74) *Attorney, Agent, or Firm* — Taft Stettinius & Hollister LLP

(57) ABSTRACT

An anti-barricading thumb turn assembly is configured for use with a lockset including a bolt movable to lock and unlock a door. The anti-barricading thumb turn assembly includes a spindle connected to a thumb turn with a biasing member on one side of the lockset. The lockset is also operable by a key from the other side of the door to lock and unlock the door. Under normal operation, the spindle and thumb turn rotate as the bolt is locked and unlocked. In a barricading situation in which the thumb turn is held in an attempt to prevent the spindle from rotating, the biasing member allows the spindle to rotate relative to the thumb turn upon application of sufficient force through rotation of the key to overcome the biasing force and unlock the bolt even if the thumb turn is held stationary.

22 Claims, 3 Drawing Sheets

(56) References Cited

U.S. PATENT DOCUMENTS

| | | | | |
|---|---|---|---|---|
| 4,941,697 | A * | 7/1990 | Fan | E05B 17/0058 292/252 |
| 5,040,652 | A | 8/1991 | Fish et al. | |
| 5,787,743 | A | 8/1998 | Weigard | |
| RE36,209 | E | 5/1999 | Walls | |
| 6,386,602 | B1 * | 5/2002 | Lan | E05B 3/065 292/336.3 |
| 6,425,273 | B1 * | 7/2002 | Kim | E05B 55/005 292/336.3 |
| 6,527,314 | B2 * | 3/2003 | Brown | E05B 13/005 292/336.3 |
| 7,128,191 | B2 * | 10/2006 | Fisher | E05B 81/25 188/265 |
| 7,963,134 | B2 | 6/2011 | Rafferty et al. | |
| 8,141,400 | B2 | 3/2012 | Sorensen et al. | |
| 8,347,672 | B2 | 1/2013 | Habecke | |
| 8,353,188 | B1 | 1/2013 | Byerly et al. | |
| 8,979,428 | B2 | 3/2015 | Ferraiolo | |
| 2010/0327611 | A1 | 12/2010 | Rees | |
| 2016/0258189 | A1 * | 9/2016 | Frolov | E05B 63/08 |

FOREIGN PATENT DOCUMENTS

| | | |
|---|---|---|
| GB | 2469652 | 5/2014 |
| WO | 2008043150 | 4/2008 |

* cited by examiner

ANTI-BARRICADING THUMB TURN ASSEMBLY FOR A DOOR LOCKSET

TECHNICAL FIELD

The present disclosure generally relates to a lockset for a door, and more particularly but not exclusively relates to a thumb turn assembly for the lockset that is configured to prevent barricading.

BACKGROUND

Locksets can be provided that have a lock with a bolt that is operated by a key from one side of the door and a thumb turn on the other side of the door. Key operation of the lock can be blocked by someone holding the thumb turn to barricade the door to prevent the lock cylinder from being fully rotated by the key to retract the bolt. This can be problematic in certain situations, such as in schools, hospitals, behavioral health facilities, prisons, and public spaces where access to a space secured by the lock by proper authorities needs to be provided at all times.

Prior attempts to prevent barricading of a door by using the lock require a clutching mechanism that needs to be re-set if disengaged while overcoming a barricading situation. These devices may not be able to be re-set properly, requiring disassembly of the lock and potentially causing other issues. Therefore, a need remains for further improvements in this technological field.

SUMMARY

An exemplary anti-barricading thumb turn assembly is configured for use with a lockset including a bolt operable to move in a locking or extending direction and an unlocking or retracting direction to lock and unlock a door. The thumb turn assembly rotates by operation of a key on one side of the lockset or a thumb turn on the other side of the lockset to lock and unlock the bolt by rotation of the thumb turn assembly. The thumb turn assembly includes a spindle that is connected to the thumb turn with a biasing member. Under normal operation, the spindles rotate to lock and unlock the bolt by using either the key or the thumb turn. In a barricading situation in which the thumb turn is held to prevent the spindle from rotating, the biasing member allows the spindle to rotate while the thumb turn is held stationary upon application of sufficient force through rotation of the key to overcome the biasing force of the biasing member. The spindle can be rotated sufficiently to unlock the bolt even if the thumb turn is held to keep the spindle from rotating. Further embodiments, forms, features, and aspects of the present application shall become apparent from the description and figures provided herewith.

DETAILED DESCRIPTION OF ILLUSTRATIVE EMBODIMENTS

Figure 1:
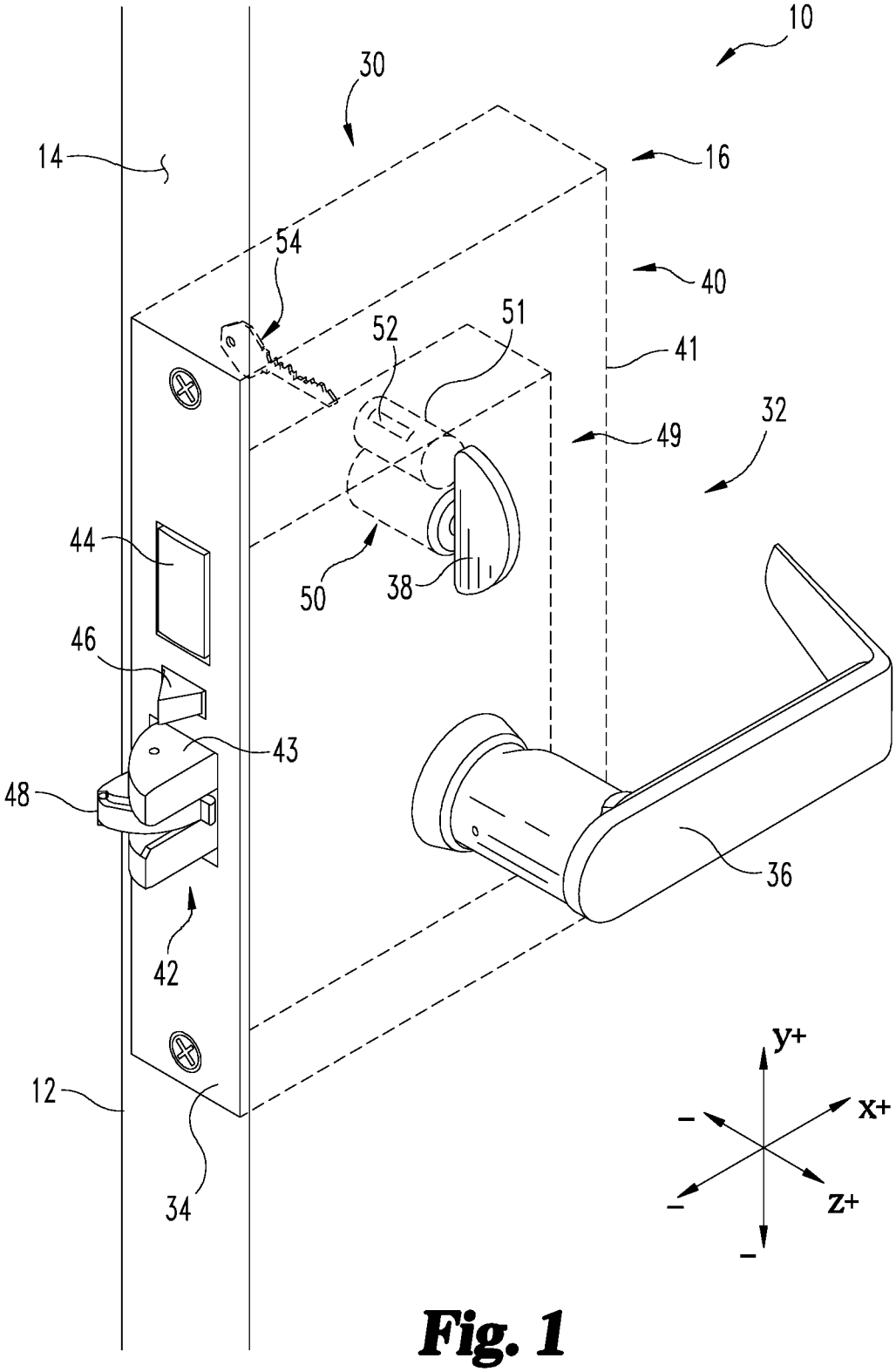
FIG. 1 illustrates a closure assembly with a lockset according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

As used herein, the terms "lateral," "longitudinal," and "transverse" are used to denote motion or spacing along three mutually perpendicular axes, wherein each of the axes defines two opposite directions. In the coordinate system illustrated in FIG. 1, the X-axis defines first (+) and second (−) lateral directions, the Y-axis defines first and second longitudinal directions, and the Z-axis defines first and second transverse directions. The longitudinal directions defined by the Y-axis may alternatively be referred to herein as the upward direction ($Z^-$) and the downward ($Y^-$) direction, and the transverse directions defined by the Z-axis may alternatively be referred to herein as the forward direction ($Z^+$) and the rearward direction ($Z^-$). In the orientation illustrated in FIG. 1, the lateral axis (X) and transverse axis (Z) are horizontal axes, and the longitudinal axis (Y) is a vertical axis. However, it is to be appreciated that these terms are used for ease and convenience of description, and are without regard to the orientation of the system with respect to the environment. For example, descriptions that reference a longitudinal direction may be equally applicable to a vertical direction, a horizontal direction, or an off-axis orientation with respect to the environment.

Furthermore, motion or spacing along a direction defined by one of the axes need not preclude motion or spacing along a direction defined by another of the axes. For example, elements which are described as being "laterally offset" from one another may also be offset in the lateral, longitudinal and/or transverse directions, or may be aligned in the lateral, longitudinal and/or transverse directions. The terms are therefore not to be construed as limiting the scope of the subject matter described herein.

With reference to FIG. 1, illustrated therein is a closure assembly 10 and a lockset 30, according to certain embodiments. The closure assembly 10 includes a door 12, and may further be considered to include the lockset 30. The door 12 includes a free edge 14 and a door cutout 16 that extends from the free edge 14, and in which at least a portion of the lockset 30 is seated. The door 12 is pivotally mounted to a frame (not shown) for swinging movement between an open position in which the free edge 14 is offset from a side jamb (not shown), and a fully-closed position in which the free edge 14 is aligned with the side jamb.

In the illustrated embodiment, the lockset 30 is provided in the form of a mortise lockset, and includes a trim assembly 32 mounted to the face of the door 12, and a mortise chassis 40 seated in the door cutout 16. The lockset 30 also includes a faceplate 34 that is secured to the free edge 14 of the door 12, thereby retaining the chassis 40 within the door cutout 16. The trim assembly 32 includes a first manual actuator and a second manual actuator, which in the illustrated embodiment are provided in the form of a handle 36 and a thumb turn 38, respectively. One example of a suitable mortise lockset is disclosed in U.S. Pat. No. 8,997,534 which is incorporated herein by reference, although other types of locksets and mortise locksets are also contemplated herein.

The chassis 40 includes a latchbolt 42, a deadbolt 44, and a mortise case 41 in which the bolts 42, 44 are movably mounted. The chassis 40 may further include a trigger 46, which in the illustrated form is movably mounted between the latchbolt 42 and the deadbolt 44. Each of the latchbolt 42 and the deadbolt 44 is movable between an extended position in which the bolt 42/44 projects beyond the faceplate 34 and is operable to engage the strike box (not shown), and a retracted position in which the bolt 42/44 is positioned at least primarily within the case 41. Similarly, the trigger 46 is movable between a projected position in which the trigger 46 projects beyond the faceplate 34, and a depressed position in which the trigger 46 is positioned at least primarily within the case 41. The latchbolt 42 is biased toward its extended position, and the trigger 46 is biased toward its projected position. The latchbolt 42 includes a latchbolt head 43, and may further include a tongue 48 movably mounted to the latchbolt head 43. The tongue 48 may facilitate movement of the latchbolt 42 between its extended and retracted positions, for example by reducing or counteracting resistive forces resulting from frictional engagement with the faceplate 34, the case 41 and/or the strike box.

The chassis 40 further includes a transmission assembly 49 that is operatively connected with the trim assembly 32, the latchbolt 42, and the deadbolt 44. More specifically, the transmission assembly 49 drivingly connects the handle 36 with the latchbolt 42, and drivingly connects the thumb turn 38 with the deadbolt 44. As a result, the handle 36 is manually operable to drive the latchbolt 42 from its extended position to its retracted position, and the thumb turn 38 is manually operable to drive the deadbolt 44 between its extended and retracted positions. In one embodiment, the transmission assembly 49 is also operatively connected with the trigger 46.

In certain embodiments, the transmission assembly 49 may connect the deadbolt 44 with one or more other components of the lockset 30 to provide for automatic movement of the deadbolt 44 in response to one or more actions. For example, the transmission assembly 49 may be configured to retract the deadbolt 44 in response to actuation of the handle 36, thereby providing for automatic unlocking when the lockset 30 is operated from the secured side of the door 12. As another example, the transmission assembly 49 may interconnect the latchbolt 42, the deadbolt 44, and the trigger 46 to provide for automatic extension of the deadbolt 44 when the door 12 is driven to its closed position. In such forms, the transmission assembly 49 may be configured to drive the deadbolt 44 toward its extended position in response to extension of the latchbolt 42 when the trigger 46 is in its depressed position, thereby providing for automatic locking when the door 12 is closed. The transmission assembly 49 may also include a thumb turn assembly 50 connected to one or both of bolts 42/44 that is operable to extend or retract bolts 42/44 by manual operation of thumb turn 38 on one side of door 12 and/or a key 54 inserted in a keyway 52 of a lock cylinder 51 on the other side of the door 12. The transmission assembly 49 may be provided in any of a number of forms known within the art, and the manner in which transmission assembly 49 performs the above-described functions need not be described in further detail herein.

When the door 12 is in its closed position and the bolts 42/44 move toward the extended positions thereof, the bolts 42/44 travel in the second lateral ($X^-$) direction. When the bolts 42/44 are subsequently moved toward the retracted positions thereof, the bolts 42/44 travel in the first lateral ($X^+$) direction. Accordingly, the second lateral ($X^-$) direction and the first lateral ($X^+$) direction may alternatively be referred to as the bolt-extending ($X^-$) direction and the bolt-retracting ($X^+$) direction, respectively.

Figure 2:
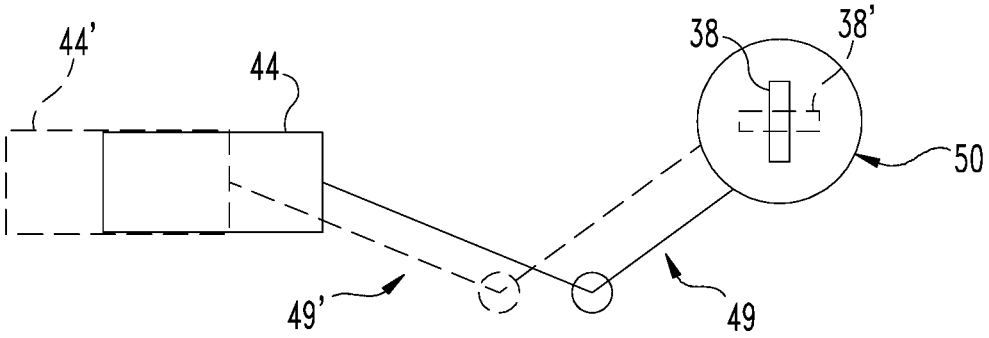
FIG. 2 is a schematic of a part of the lockset of FIG. 1 and shows a bolt in an extended position and retracted position by operation of a thumb turn assembly.

During operation of the closure assembly 10, the door 12 may be driven from its open position to its closed position. When the door 12 approaches its fully-closed position, the latchbolt 42 enters the latchbolt opening of the strike box as the chassis 40 returns the latchbolt 42 to its extended position. With the trigger 46 retained in its depressed position, the transmission assembly 49 may drive the deadbolt 44 toward its extended position in response to extension of the latchbolt 42, thereby causing the deadbolt 44 to enter the deadbolt opening of the strike box. Alternatively or additionally, as shown in FIG. 2, the retracted or unlocked deadbolt 44 may be driven to its extended or locked position 44' by transmission assembly 49 as shown by transmission assembly 49' via manual operation of the thumb turn 38 to a rotated position 38'. The deadbolt 44 may also be driven to its extended position 44' by manual operation of key 54 inserted in keyway 52 for rotation of the thumb turn assembly 50 from the other side of door 12. With the bolts 42, 44 received in the openings of the strike box, the door 12 is secured in its closed position relative to the frame.

Figure 4:
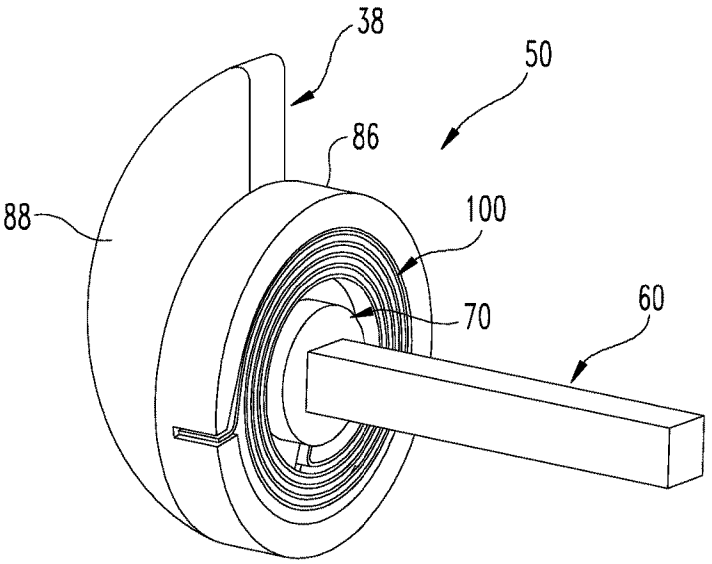
FIG. 4 is a perspective assembly view of the thumb turn assembly of FIG. 2.
Figure 3:
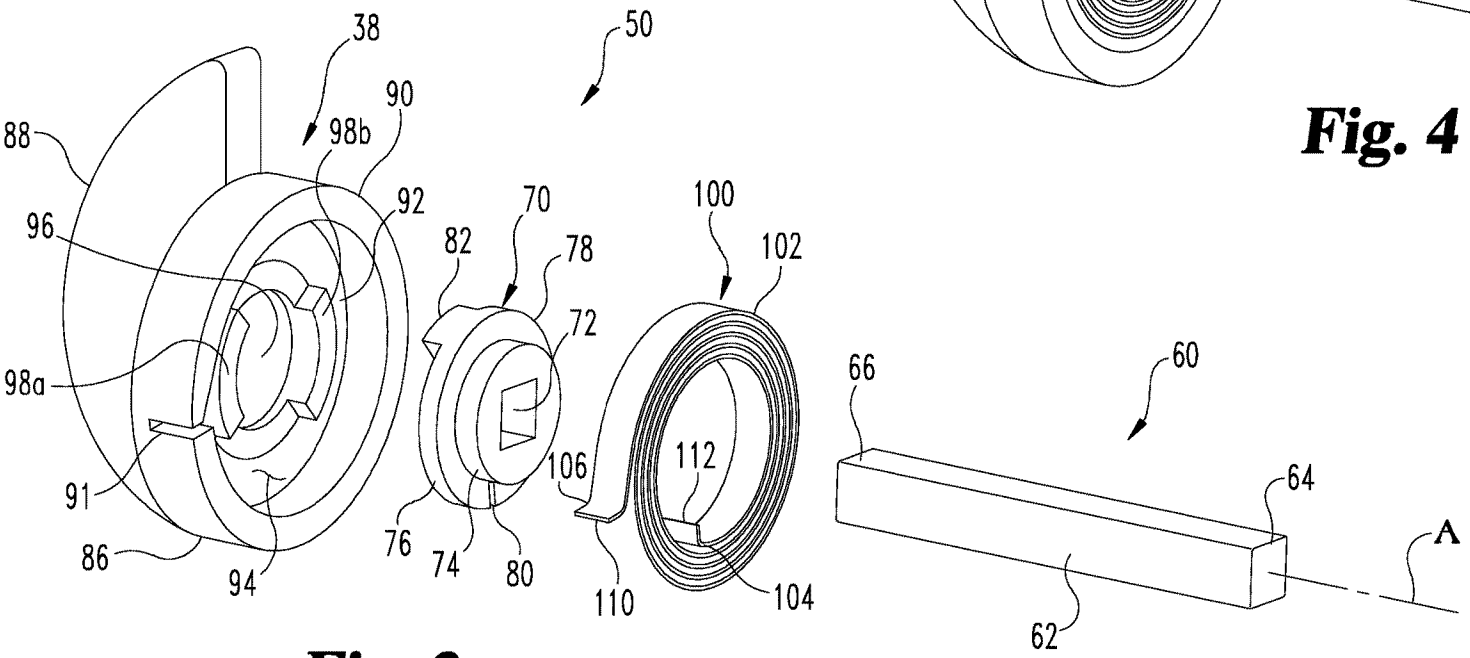
FIG. 3 is an exploded perspective view of the thumb turn assembly of FIG. 2.

A person or persons may barricade his or her self in a room or area secured by door 12 by holding handle 36 and/or thumb turn 38 to defeat retracting bolt 42/44 by operation of key 54. As shown in FIGS. 3-4, thumb turn assembly 50 is configured to defeat barricading by allowing the bolt 42/44 to retract via operation of the key 54 even if handle 36 and/or thumb turn 38 is held stationary.

Thumb turn assembly 50 includes an elongated spindle 60 that is engaged to transmission assembly 49 so that rotation of spindle 60 operates the transmission assembly 49 to lock and unlock bolt 42/44. Spindle 60 includes a body 62 that extends between a first end 64 and an opposite second end 66 along a center axis A. In the illustrated embodiment, body 62 is an elongated solid shaft with a non-circular cross-section, such as a square cross-section. However, other cross-sectional shapes are also contemplated by body 62. In one embodiment, in the installed position of lockset 30 the center axis A is aligned with or parallel to the transverse axis (Z).

First end 64 of body 62 is positioned in engagement with transmission assembly 49 so that rotation of thumb turn assembly 50 is transmitted to bolt 42/44. The second end 66 of body 62 is engaged to thumb turn 38 via a hub 70 and a biasing member 100. Thumb turn 38 is configured to rotate about center axis A to rotate spindle 60 and lock and unlock the door under normal (non-barricading) operation.

In the illustrated embodiment, hub 70 includes a center passage 72 that receives the body 62 of spindle 60. Hub 70 also includes a cylindrical first body section 74 and a cylindrical second body section 76 that are positioned along center axis A so that second body section 76 is located toward thumb turn 38 and the first body section 74 is located on and projects axially from second body section 76 opposite of thumb turn 38. The second body section 76 also projects radially outwardly from the first body section 74. The second body section 76 has an outer wall 78 that defines a groove 80 extending radially inwardly therein to engage biasing member 100, as discussed further below. Second body section 76 also includes at least one hub arm 82 projecting axially therefrom toward thumb turn 38.

Thumb turn 38 includes a base member 86 and a handle member 88 projecting from base member 86 that can be grabbed by the user to manipulate thumb turn assembly 50. Handle member 88 is in the form of a semi-circular plate in the illustrated embodiment, but any suitable configuration is contemplated. Base member 86 includes an outer cylindrical wall 90 that defines a cavity 92 for receiving hub 70 therein. The cavity 92 includes an inner wall 94 with a hole 96 therethrough. First and second legs **98*a*, 98*b* extend axially from inner wall 94 on opposite sides of hole 96 toward hub 70 so the legs 98*a*, 98*b* interact with biasing member 100 to maintain it in alignment around the hub 70. In addition, the one or more hub arms 82 can be received in hole 96 to maintain hub 70 in rotational alignment with base member 86**.

Outer cylindrical wall 90 also includes a slot 91 extending therein for engagement to biasing member 100. In the illustrated embodiment, biasing member 100 is a torsion spring with two or more coils formed by a bar 102 that is wound between an inner end 104 and an outer end 106. The inner end 104 is bent to form a first flange 112 and the outer end 106 is bent to form a second flange 110.

Biasing member is coupled between hub 70 and thumb turn 38 with first flange 112 engaged in groove 80 of hub 70 and second flange 110 engaged in slot 91 of base member 86. The coiled body of biasing member 100 is positioned around hub 70 within the cavity 92. Biasing member 100 is configured so that under normal conditions the rotation of thumb turn 38 is transferred to spindle 60 to extend and retract bolt 42/44 for locking and unlocking. However, if thumb turn 38 is held in position to attempt to barricade the lock, then a key 54 inserted into keyway 52 to unlock the door can be used to overcome the force of biasing member 100 and rotate spindle 60 to retract the bolt 42/44 to unlock the lock while thumb turn 38 remains stationary.

Various aspects of the present disclosure are contemplated. For example, according to one aspect, an anti-barricading system for a door includes a lockset configured for mounting to the door. The lockset includes a lockset housing configured for mounting within the door and at least one bolt mounted for movement relative to the lockset housing between a locked position and an unlocked position. The lockset includes a thumb turn on one side of the door for moving the bolt between the locked position and the unlocked position and a keyway on the other side of the door for receiving a key for moving the bolt between the locked position and the unlocked position. The system also includes a thumb turn assembly mounted to the lockset. The thumb turn assembly includes a spindle engaged to the thumb turn and a biasing member coupled to the spindle. The biasing member is configured so that rotation of the thumb turn rotates the thumb turn assembly to move the bolt between the locked position and the unlocked position and rotation of the key rotates the thumb turn and the thumb turn assembly together to move the bolt between the locked position and the unlocked position. In response to the thumb turn being held from rotation, the biasing member is configured to allow the thumb turn assembly including the spindle to rotate in response to sufficient force being applied to overcome the biasing force of the biasing member with rotation of the key to move the bolt between the locked position and the unlocked position while the thumb turn remains stationary.

In one embodiment of the system, the thumb turn assembly includes a base member for mounting to the lockset and a hub positioned in the base member, and the spindle is coupled to the hub so that rotation of the spindle rotates the hub. In a refinement of this embodiment, the biasing member is engaged between the base member and the hub. In a further refinement, the biasing member is a torsion spring that extends around the hub within the base member. In yet a further refinement, the torsion spring includes at least two coils that extend around the hub. In still a further refinement, a first end of the torsion spring includes a first flange that is engaged in a groove formed in an outer periphery of the hub and a second end of the torsion spring includes a second flange that is engaged in a slot of the base member.

In another embodiment of the system, a hub is provided that includes a central passage for receiving the spindle to fixedly couple the spindle to the hub. In one refinement, the passage is non-circular and the spindle includes a non-circular cross-section. In another refinement, the base member includes an outer sidewall that extends around a cavity of the base member, and the hub is positioned in the cavity. In yet a further refinement, the base member includes a hole in the cavity and the hub includes a central passage for receiving the spindle with the central passage in alignment with the hole.

According to another aspect, an anti-barricading thumb turn assembly is provided for use with a lockset including a movable bolt. The thumb turn assembly includes a thumb turn positionable on a first side of the lockset for moving the bolt between a locked position and an unlocked position and a spindle that is engaged to the thumb turn. The thumb turn assembly also includes a biasing member coupled to the spindle. The biasing member is configured so that rotation of the thumb turn rotates the spindle to move the bolt between the locked position and the unlocked position. In response to the thumb turn being held from rotation, the biasing member is configured to allow the spindle to rotate in response to sufficient force being applied to overcome the biasing force of the biasing member with rotation of a key from a second side of the lockset to move the bolt between the locked position and the unlocked position while the thumb turn remains stationary.

In one embodiment of the assembly, the biasing member is coupled to the spindle with a hub that is positioned within a base member and the biasing member extends between and is engaged to the base member and to the hub.

In another embodiment of the assembly, a base member is provided for mounting with the lockset and a hub positioned in the base member, and the spindle is coupled to the hub so that rotation of the spindle rotates the hub. In a refinement of this embodiment, the biasing member is engaged between the base member and the hub. In a further refinement, the biasing member is a torsion spring that is positioned within the base member and extends around the hub. In still a further refinement, the torsion spring includes an elongated bar that forms at least two coils extending between an inner end within the at least two coils and an outer end outside of the at least two coils. In still a further refinement, the inner end of the torsion spring is engaged to the hub and the outer end of the torsion spring is engaged to the base member. In yet a further refinement, the inner end and the outer end of the torsion spring each includes a flange for engaging respective ones of the hub and the base member.

In another embodiment of the assembly, a base member of the thumb turn includes an outer sidewall that extends around a cavity of the base member, and the hub is positioned in the cavity. In a refinement of this embodiment, the base member includes a hole in the cavity and the hub includes a central passage for receiving the spindle with the central passage in alignment with the hole.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An anti-barricading system for a door, the system comprising:

a lockset configured for mounting to the door, the lockset including:

a lockset housing configured for mounting within the door;

at least one bolt mounted for movement relative to the lockset housing between a locked position and an unlocked position, wherein the lockset includes a thumb turn on one side of the door for moving the bolt between the locked position and the unlocked position and a keyway on the other side of the door for receiving a key for moving the bolt between the locked position and the unlocked position;

a thumb turn assembly mounted to the lockset, the thumb turn assembly including:

a spindle engaged to the thumb turn; and a biasing member including a first end coupled to the spindle and an opposite second end coupled to the thumb turn such that the spindle is engaged to the thumb turn via the biasing member, wherein the biasing member is configured so that rotation of the thumb turn rotates the thumb turn assembly to move the bolt between the locked position and the unlocked position and rotation of the key rotates the thumb turn and the thumb turn assembly together to move the bolt between the locked position and the unlocked position, and wherein in response to the thumb turn being held from rotation the biasing member is configured to allow the thumb turn assembly including the spindle to rotate in response to sufficient force being applied to overcome the biasing force of the biasing member with rotation of the key to move the bolt between the locked position and the unlocked position while the thumb turn remains stationary.

2. The system of claim 1, wherein the thumb turn assembly includes a base member for mounting to the lockset and a hub positioned in the base member, wherein the spindle is coupled to the hub so that rotation of the spindle rotates the hub.

3. The system of claim 2, wherein the biasing member is a torsion spring that extends around the hub within the base member.

4. The system of claim 3, wherein the torsion spring includes at least two coils that extend around the hub.

5. The system of claim 4, wherein a first end of the torsion spring includes a first flange that is engaged in a groove formed in an outer periphery of the hub and a second end of the torsion spring includes a second flange that is engaged in a slot of the base member.

6. The system of claim 2, wherein the hub includes a central passage for receiving the spindle to fixedly couple the spindle to the hub.

7. The system of claim 6, wherein the passage is non-circular and the spindle includes a non-circular cross-section.

8. The system of claim 2, wherein the base member includes an outer sidewall that extends around a cavity of the base member, and the hub is positioned in the cavity.

9. The system of claim 8, wherein the base member includes a hole in the cavity and the hub includes a central passage for receiving the spindle with the central passage in alignment with the hole.

10. An anti-barricading thumb turn assembly for use with a lockset including a movable bolt, the thumb turn assembly comprising:

a thumb turn positionable on a first side of the lockset for moving the bolt between a locked position and an unlocked position;

a spindle that is engaged to the thumb turn; and a biasing member including a first end coupled to the spindle and an opposite second end coupled to the thumb turn such that the spindle is engaged to the thumb turn via the biasing member, wherein the biasing member is configured so that rotation of the thumb turn rotates the spindle to move the bolt between the locked position and the unlocked position, and wherein in response to the thumb turn being held from rotation the biasing member is configured to allow the spindle to rotate in response to sufficient force being applied to overcome the biasing force of the biasing member with rotation of a key from a second side of the lockset to move the bolt between the locked position and the unlocked position while the thumb turn remains stationary.

11. The thumb turn assembly of claim 10, further comprising a base member for mounting with the lockset and a hub positioned in the base member, wherein the spindle is coupled to the hub so that rotation of the spindle rotates the hub.

12. The thumb turn assembly of claim 11, wherein the biasing member is a torsion spring that is positioned within the base member and extends around the hub.

13. The thumb turn assembly of claim 12, wherein the torsion spring includes an elongated bar that forms at least two coils extending between an inner end within the at least two coils and an outer end outside of the at least two coils.

14. The thumb turn assembly of claim 13, wherein the inner end of the torsion spring is engaged to the hub and the outer end of the torsion spring is engaged to the base member.

15. The thumb turn assembly of claim 14, further wherein the inner end and the outer end of the torsion spring each includes a flange for engaging respective ones of the hub and the base member.

16. The thumb turn assembly of claim 11, wherein the base member includes an outer sidewall that extends around a cavity of the base member, and the hub is positioned in the cavity.

17. The thumb turn assembly of claim 16, wherein the base member includes a hole in the cavity and the hub includes a central passage for receiving the spindle with the central passage in alignment with the hole.

18. The thumb turn assembly of claim 10, wherein the biasing member is coupled to the spindle with a hub that is positioned within a base member and the biasing member extends between and is engaged to the base member and to the hub.

19. An anti-barricading thumb turn assembly, comprising:

a thumb turn;

a hub rotatably mounted within the thumb turn;

a spindle rotationally coupled with the hub and configured for connection with a bolt of a lockset; and a spring including a first end coupled with the thumb turn and an opposite second end coupled with the hub such that the thumb turn and the spindle are engaged with one another via the spring and the hub.

20. The anti-barricading thumb turn assembly of claim 19, wherein the spring is a torsion spring.

21. The anti-barricading thumb turn assembly of claim 20, wherein the thumb turn includes a first slot in which the first end of the torsion spring is received; and wherein the hub includes a second slot in which the second end of the torsion spring is received.

22. A system including the anti-barricading thumb turn assembly of claim 19, the system further comprising:

a lockset housing;

a bolt mounted for movement relative to the lockset housing between a locked position and an unlocked position; and a lock cylinder mounted to a first side of the lockset housing and engaged with the bolt such that the lock cylinder is operable to move the bolt between the locked position and the unlocked position;

wherein the anti-barricading thumb turn assembly is mounted to an opposite second side of the lockset housing and the spindle is engaged with the bolt such that the thumb turn is operable to move the bolt between the locked position and the unlocked position.

* * * * *